US007971871B2

(12) United States Patent
Partridge et al.

(10) Patent No.: US 7,971,871 B2
(45) Date of Patent: Jul. 5, 2011

(54) TRAY EXIT RAMP

(75) Inventors: Colin Jon Partridge, Baldock (GB); Michael George Snelling, Hitchin (GB); Ian Alan Parks, St. Albans (GB); Julia Allwright, London (GB)

(73) Assignee: Xerox Corporation, Norwalk, CT (US)

( * ) Notice: Subject to any disclaimer, the term of this patent is extended or adjusted under 35 U.S.C. 154(b) by 176 days.

(21) Appl. No.: 12/431,949

(22) Filed: Apr. 29, 2009

(65) Prior Publication Data

US 2010/0276876 A1 Nov. 4, 2010

(51) Int. Cl.
*B65H 1/00* (2006.01)

(52) U.S. Cl. ..... 271/145; 271/162; 271/167

(58) Field of Classification Search ..... 271/145, 271/162, 167, 169, 170; 399/393
See application file for complete search history.

(56) References Cited

U.S. PATENT DOCUMENTS

| | | | | |
|---|---|---|---|---|
| 5,480,247 | A * | 1/1996 | Saikawa et al. | 400/629 |
| 5,848,787 | A | 12/1998 | Miki | |
| 6,302,390 | B1 | 10/2001 | Clark et al. | |
| 6,939,068 | B2 | 9/2005 | Rawlings et al. | |
| 7,188,835 | B2 | 3/2007 | Lee et al. | |
| 2002/0000691 | A1 | 1/2002 | Takai | |
| 2008/0088080 | A1 | 4/2008 | Liu et al. | |

FOREIGN PATENT DOCUMENTS

GB 2259499 A 3/1993

* cited by examiner

*Primary Examiner* — David H Bollinger
(74) *Attorney, Agent, or Firm* — Pepper Hamilton LLP

(57) ABSTRACT

A sheet stacking tray assembly may include a tray having a lead edge surface, a tray exit ramp having a first end and a second end, and a feeder having a feeder edge. The first end of the tray exit ramp may be configured to connect to the lead edge surface. The tray exit ramp may be convex relative to the lead edge surface and may extend beyond the lead edge surface. The tray exit ramp may include one or more first anti-stub surfaces, that may be configured to be positioned below a lead edge of a sheet in a sheet stack. The feeder edge of the feeder may include one or more second anti-stub surfaces that are complementary to the first anti-stub surfaces. The feeder edge may be configured to interconnect with the second end of the tray exit ramp to form a transition surface.

15 Claims, 5 Drawing Sheets

TRAY EXIT RAMP

CROSS-REFERENCE TO RELATED APPLICATIONS

This application is related to U.S. patent application Ser. No. 12/432,051 filed on Apr. 29, 2009.

BACKGROUND

It is common for paper stacks, such as those located in a print tray, to be affected by environmental conditions. For example, paper may absorb moisture from the air which may induce the paper to curl along one or more edges. Typical resources include a tray connected to a feeder. The tray usually holds a stack of paper or other media that is fed from the tray to the feeder via a tray edge. However, it is common for a resource to transition down curled paper from a tray to a feeder in the same manner that normal paper is transitioned. Paper having downcurled edges is often difficult to feed from a tray because the edges commonly catch or stub on the tray en route to the feeder. In addition, even if the curled paper is properly fed, it is likely to cause a paper jam, which not only frustrates the customer but also reduces the overall feeding quality and capabilities of the printing device.

SUMMARY

Before the present methods are described, it is to be understood that this invention is not limited to the particular systems, methodologies or protocols described, as these may vary. It is also to be understood that the terminology used herein is for the purpose of describing particular embodiments only, and is not intended to limit the scope of the present disclosure which will be limited only by the appended claims.

It must be noted that as used herein and in the appended claims, the singular forms "a," "an," and "the" include plural reference unless the context clearly dictates otherwise. Thus, for example, reference to a "sheet" is a reference to one or more sheets and equivalents thereof known to those skilled in the art, and so forth. Unless defined otherwise, all technical and scientific terms used herein have the same meanings as commonly understood by one of ordinary skill in the art. As used herein, the term "comprising" means "including, but not limited to."

In an embodiment, a sheet stacking tray assembly may include a tray having a lead edge surface, a tray exit ramp having a first end and a second end, and a feeder having a feeder edge. The first end of the tray exit ramp may be configured to connect to the lead edge surface. The tray exit ramp may be convex relative to the lead edge surface and may extend beyond the lead edge surface. The tray exit ramp may include one or more first anti-stub surfaces, that may be configured to be positioned below a lead edge of a sheet in a sheet stack. The feeder edge of the feeder may include one or more second anti-stub surfaces that are complementary to the first anti-stub surfaces. The feeder edge may be configured to interconnect with the second end of the tray exit ramp to form a transition surface.

In an embodiment, a sheet stacking tray assembly may include a tray having a lead edge surface, a plurality of tray exit ramps coupled to the lead edge surface and a feeder having a feeder edge. The tray exit ramps may be coupled to the lead edge surface. Each tray exit ramp may be convex relative to the lead edge surface and may extend beyond the lead edge surface. Each tray exit ramp may include one or more anti-stub surfaces that are configured to guide a downwardly turned edge of a sheet from the tray to the feeder. The feeder may include a feeder edge that may include one or more second anti-stub surfaces that are complementary to one or more of the first anti-stub surfaces. The feeder edge may be configured to interconnect with the plurality of tray exit ramps to form a transition surface.

BRIEF DESCRIPTION OF THE DRAWINGS

Aspects, features, benefits and advantages of the present invention will be apparent with regard to the following description and accompanying drawings, of which.

DETAILED DESCRIPTION

For purposes of the discussion below, a "resource" refers to a printer, a copier, a multifunction machine or system, a xerographic machine or system, or any other type of reproduction apparatus that is capable of printing images on at least a portion of a sheet.

A "sheet" refers to a physical sheet of paper, plastic and/or other suitable substrate for printing images thereon.

A "sheet stack" refers to a plurality of sheets arranged vertically.

Figure 1:
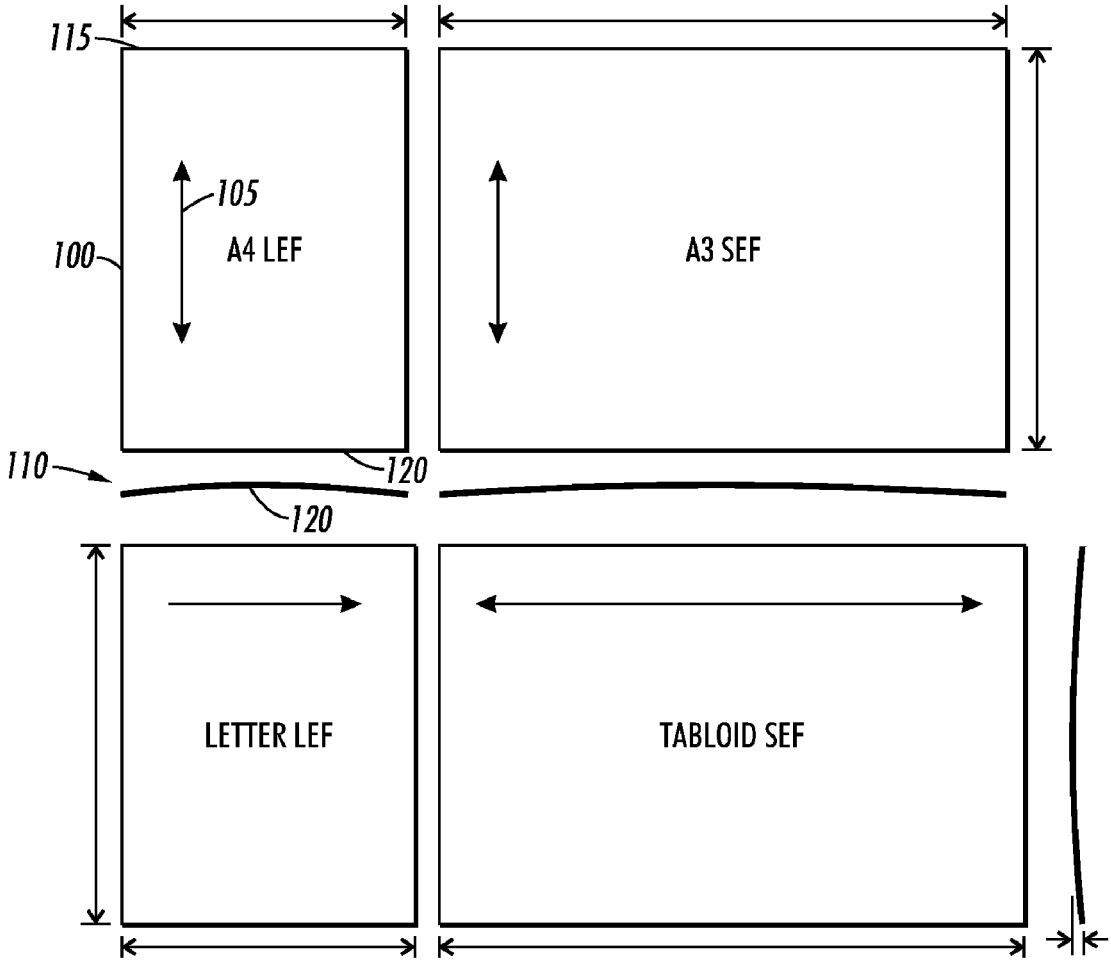
FIG. 1 illustrates various examples of how a sheet may become distorted according to an embodiment.

FIG. 1 illustrates various examples of how a sheet may become distorted due to environmental as well as other external conditions. For example, a sheet in a hot and/or wet environment may absorb moisture from the air. This absorption may induce a down curl profile along an edge perpendicular to the grain orientation of the cut. FIG. 1 illustrates how different sheets may curl based on the grain orientation. For example, the edges 115, 120 of a sheet of A4 LEF paper 100 that are perpendicular to the depicted grain orientation 105 may curl downward 110 as illustrated.

Figure 2:
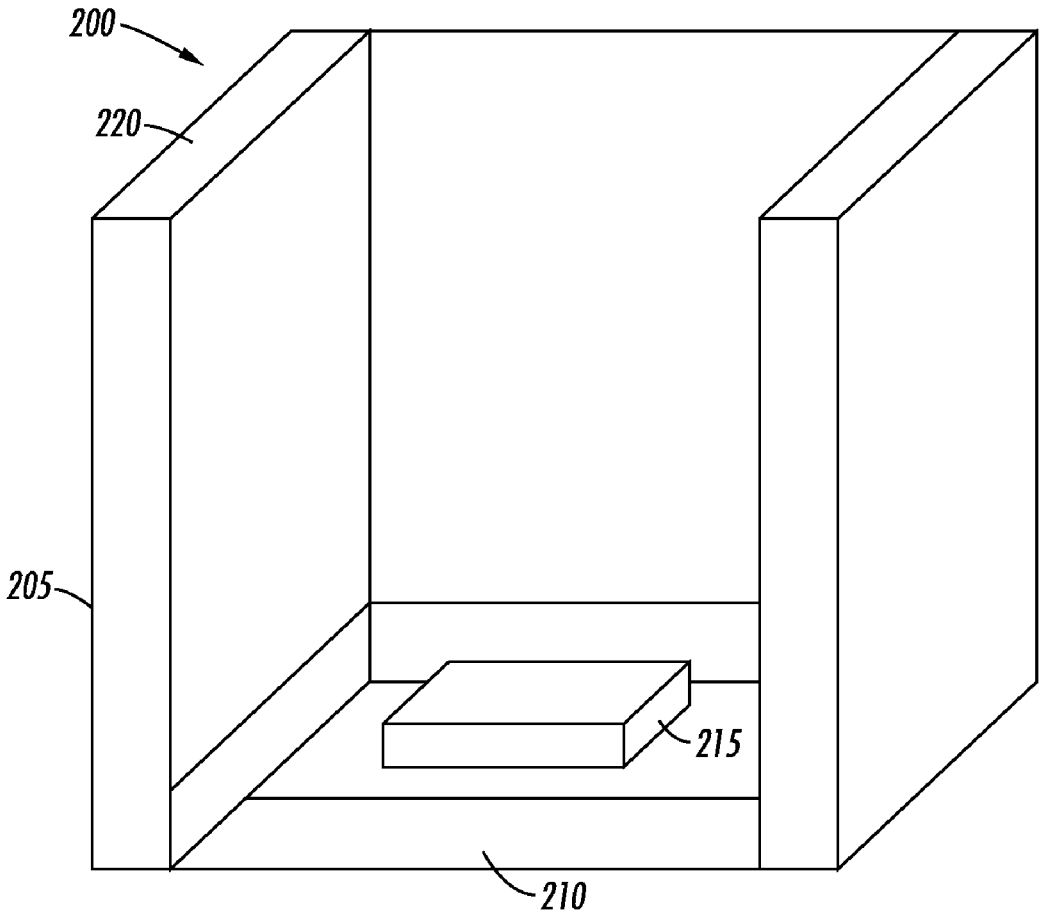
FIG. 2 depicts an exemplary tray assembly according to an embodiment.

FIG. 2 illustrates an exemplary sheet stacking tray assembly 200 according to an embodiment. A sheet stacking tray assembly 200 may be a component of a resource. In an embodiment, the sheet stacking tray assembly 200 may be mounted in a slide-out paper drawer unit of a resource. For example, a slidable print tray may comprise a sheet stacking tray assembly 200 in a printer.

In an embodiment, a sheet stacking tray assembly 200 may include a tray 205 and an elevate plate 210. The elevate plate 210 may be located within the tray 205 as illustrated in FIG. 2. In an embodiment, a sheet stack 215 may be positioned on the elevate plate 210. The sheet stack 215 may be retained on the elevate plate 210 between a plurality of guides. For example, the sheet stack 215 may be retained between two side guides, a rear guide and a front guide. In an embodiment, the elevate plate 210 may move vertically relative to the tray 205 to engage the top sheet of a sheet stack 215 with a sheet feeder.

In an embodiment, the tray may include a lead edge surface 220. The lead edge surface 220 may be a surface of the tray 205 that is located between a feeder and the elevate plate 210. In an embodiment, a sheet stack 215 may be registered against the lead edge surface 220 to position the sheets for feeding. Registering the sheet stack 215 to resource datums may facilitate the positive feeding of sheets and quality prints. For example, accurate stack registration may help minimize paper jams and/or damage to individual sheets. In addition, registration may assist in enhancing the quality of print and producing complete images that are centered on a sheet.

Figure 3:
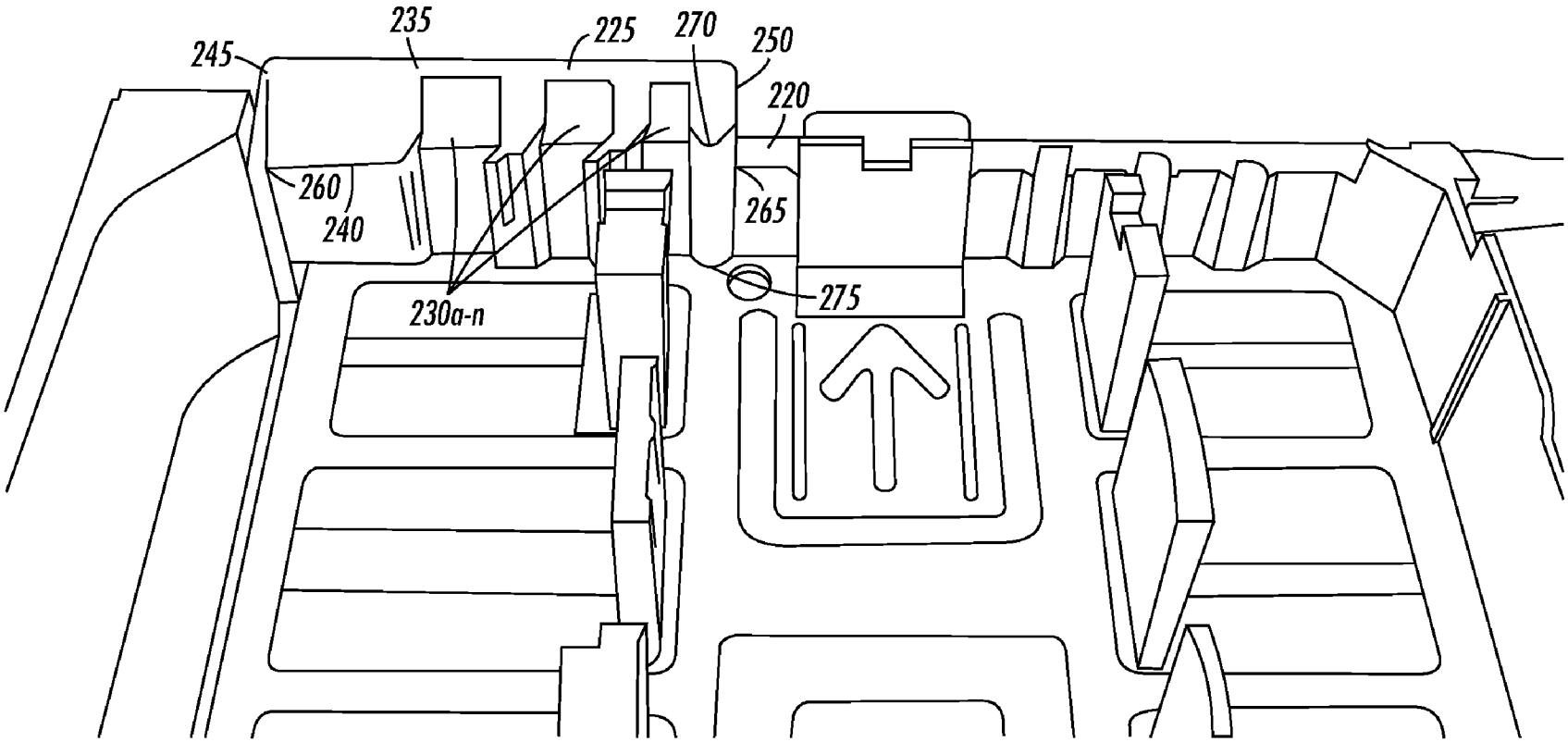
FIG. 3 illustrates an exemplary tray assembly having an exit ramp according to an embodiment.

In an embodiment, the lead edge surface 220 may include a first end 270 and a second end 275 (as shown in FIG. 3). The first end 270 may be the top end of the lead edge surface 220. In an embodiment, the second end 275 may be the bottom end of the lead surface 220. In an embodiment, the lead edge surface 220 may include a tray exit ramp 225. The tray exit ramp 225 may extend from the first end 270 of the lead edge surface 220. The tray exit ramp 225 may facilitate the movement of the top sheet of the sheet stack 215 from the elevate plate 210 to a feeder.

FIG. 3 illustrates an exemplary tray exit ramp 225 according to an embodiment. In an embodiment, the tray exit ramp 225 may be integrally formed with the lead edge surface 220. Alternatively, the tray exit ramp 225 may be removeably connected to the lead edge surface 220.

Figure 4:
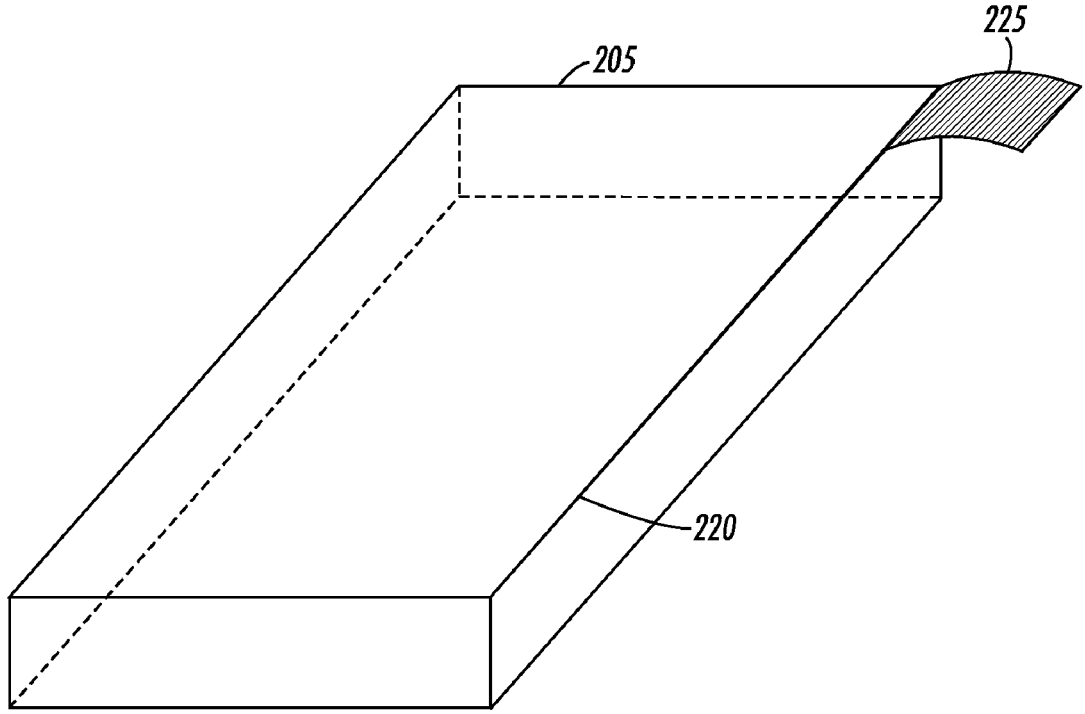
FIG. 4 illustrates an exemplary tray assembly according to an embodiment.

In an embodiment, a surface of the tray exit ramp may be outwardly arched relative to the first end 270 of the lead edge surface 220. For example, as illustrated by FIG. 4, the tray exit ramp 225 may have a convex shape and may arch upwardly and outwardly from the first end 270 of the lead edge surface 220.

As illustrated by FIG. 3, in an embodiment, the tray exit ramp 225 may comprise one or more anti-stub surfaces 230*a*-N. The anti-stub surfaces 230*a*-N may be molded into the tray exit ramp 225. The anti-stub surfaces 230*a*-N may be arched upwardly relative to the tray 205. In an embodiment, the anti-stub surfaces 230*a*-N may guide an edge and/or corners of a sheet from the tray 205 to a feeder. As such, the tray exit ramp 225 may enable the feeding of curled paper from the tray to the feeder without stubbing or damaging the exiting sheet.

In an embodiment, the tray exit ramp 225 may comprise a first side 235, a second side 240, a third side 245 and a fourth side 250. The surface profile between the first side 235 and the second side 240 may provide a smooth transition surface that may guide a sheet edge from the elevate plate to the feeder. In an embodiment, the first side 235 may extend to meet a complementary feeder guide. Alternatively, the first side 235 may be connected to the feeder. In an embodiment, the second side 240 may be connected to the first end 270 of the lead edge surface 220. In an embodiment, the tray exit ramp 225 may extend along at least a portion of the width of the first end 270 of the lead edge surface 220. For example, FIG. 3 illustrates a tray exit ramp 225 extending from a first point 260 along the first end 270 of the lead edge surface 220 to a second point 265 along the first end of the lead edge surface.

Figure 5:
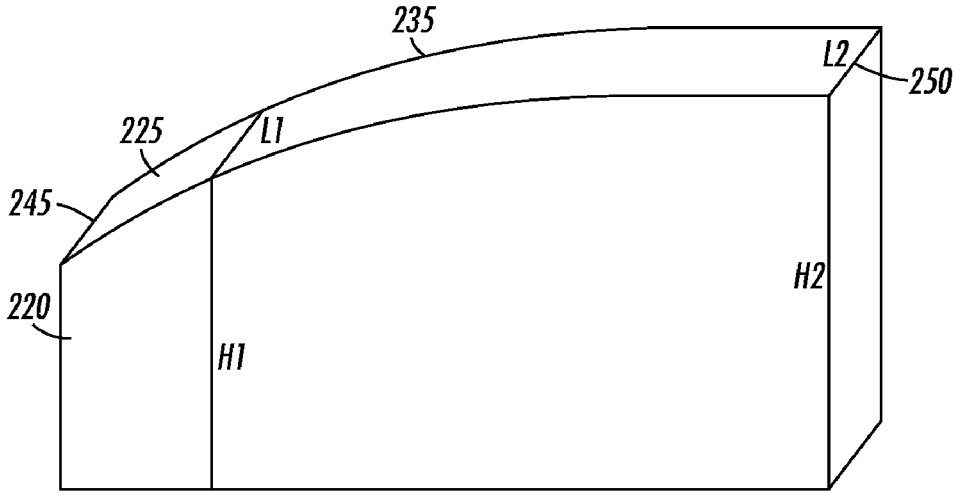
FIG. 5 illustrates an exemplary tray assembly having an exit ramp according to an embodiment.

In an embodiment, the first side 235 of the tray exit ramp 225 may be substantially parallel to the lead edge surface 220. In an embodiment, the intersection of the first end 270 of the lead edge surface 220 and the tray exit ramp 225 may have a variable height along the lead edge surface width due to the convex shape of the tray exit ramp 225. In an embodiment, the length of the tray exit ramp surface that is perpendicular to the lead edge surface 220 may decrease as the height of the lead edge surface increases. In an embodiment, the length of the tray exit ramp 225 may narrow across its width. For example, referring to FIG. 5, the length of the tray exit ramp 225 may be longer near the third side 245 of the tray exit ramp than at the fourth side 250 of the tray exit ramp (i.e., $L_1$ is longer than $L_2$). In an embodiment, the height of the lead edge surface may increase across the width of the exit tray ramp 225. For example, the height of the lead edge surface 220 near the fourth side 250 of the tray exit ramp 225 may be larger than the height of the lead edge surface near the third side 245 of the tray exit ramp (i.e., $H_2$ is larger than $H_1$).

Figure 6:
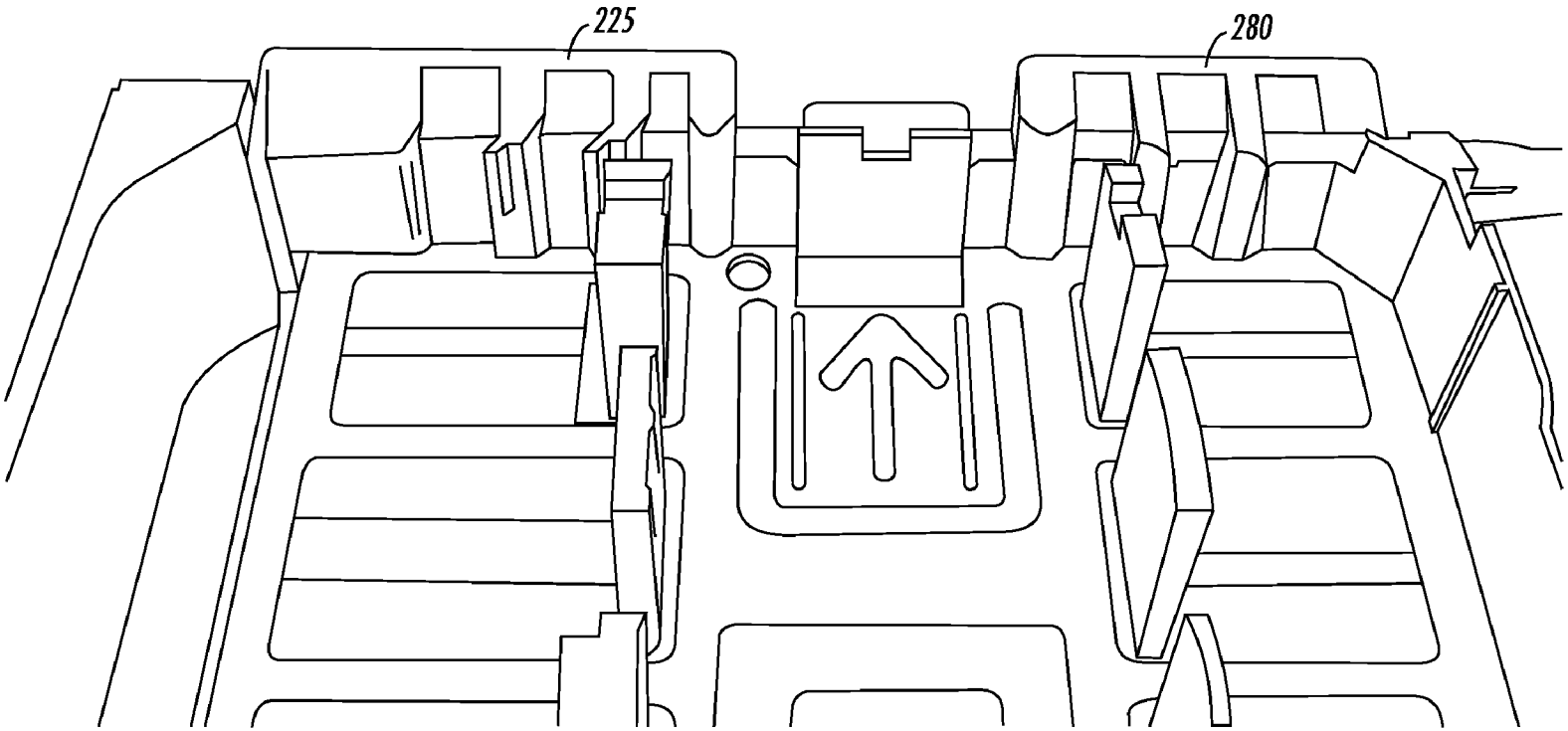
FIG. 6 illustrates an exemplary tray assembly according to an embodiment.

In an embodiment, a plurality of tray exit ramps may be connected to the tray as illustrated by FIG. 6. For example, as illustrated by FIG. 6, tray exit ramps 225, 280 may be located at either end of the lead edge surface 220. One tray exit ramp 225 may assist with transitioning a top corner of a sheet from the tray to the feeder. The other tray exit ramp 280 may assist with transitioning a bottom corner of a sheet from the tray 205 to the feeder.

In an embodiment, a tray 205 having a tray exit ramp 225 may interconnect with a feeder, such as at the first end 235 of the exit ramp. For example, the first end 235 and the feeder may be slidably interconnected. In an embodiment, the first end 235 may interfit a complimentary, geometrically formed feeder. When interconnected, the tray exit ramp 225 and the feeder may form a transition surface for sheet guidance when the tray 205 engages the feeder.

In an embodiment, a sheet having down curl may be fed from the sheet stack 215 toward the feeder. A lead edge of the sheet may be received by the tray exit ramp 225. In an embodiment, a portion of the gull-winged exit ramp 225 may be located below the top sheet in the sheet stack 215. As the sheet is fed from the sheet stack 215, one or more outer edges of the sheet may be raised substantially simultaneously by the tray exit ramp 225. In an embodiment, the raised edges may be elevated until they are substantially level with a center portion of the sheet. Once the raised outer edges are level with the center portion of the sheet, the sheet may transition from the sheet stack 215 to the feeder.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A sheet stacking tray assembly comprising:

a tray comprising a lead edge surface; and a tray exit ramp comprising a first end and a second end, wherein the first end is configured to connect to the lead edge surface, wherein the tray exit ramp is convex relative to the lead edge surface and extends beyond the lead edge surface, wherein the tray exit ramp comprises one or more first anti-stub surfaces, wherein the first anti-stub surfaces are configured to be positioned below a lead edge of a sheet in a sheet stack, wherein the second end of the tray exit ramp is configured to interconnect with a feeder to form a transition surface.

2. The sheet stacking tray assembly of claim 1, wherein the tray exit ramp is integrally formed with the lead edge surface.

3. The sheet stacking tray assembly of claim 1, wherein the tray exit ramp is removeably coupled to the lead edge surface.

4. The sheet stacking tray assembly of claim 1, wherein the second end of the tray exit ramp is configured to removeably interconnect with the feeder.

5. The sheet stacking tray assembly of claim 1, wherein the tray exit ramp extends from a first point on the lead edge surface to a second point on the lead edge surface, wherein a width of the tray exit ramp is narrower at the first point than at the second point.

6. The sheet stacking tray assembly of claim 1, wherein the second end of the tray exit ramp is configured to slidably interconnect with the feeder.

7. The sheet stacking tray assembly of claim 1, wherein the tray exit ramp is configured to elevate a downwardly curled edge of a sheet until the curled edge is substantially level with a center portion of the sheet.

8. A sheet stacking tray assembly comprising:

a tray comprising a lead edge surface; and a plurality of tray exit ramps coupled to the lead edge surface, wherein each tray exit ramp is convex relative to the lead edge surface and extends beyond the lead edge surface, wherein each tray exit ramp comprises one or more anti-stub surfaces, wherein each tray exit ramp is configured to interconnect with a feeder to form a transition surface, wherein the anti-stub surfaces of each tray exit ramp are configured to guide a downwardly turned edge of a sheet from the tray to the feeder.

9. The sheet stacking tray assembly of the claim 8, wherein a tray exit ramp is integrally formed with the lead edge surface.

10. The sheet stacking tray assembly of claim 8, wherein a tray exit ramp is removeably connected to the lead edge surface.

11. The sheet stacking tray assembly of claim 8, wherein each tray exit ramp is configured to be removeably coupled to the feeder.

12. The sheet stacking tray assembly of claim 8, wherein:

a first tray exit ramp extends from a first end of the lead edge surface to a first point on the lead edge surface, wherein a width of the first tray exit ramp is narrower at the first point than at the first end;

a second tray exit ramp extends from a second end of the lead edge surface to a second point on the lead edge surface, wherein a width of the second tray exit ramp is narrower at the second point than at the second end; and the first point is located a distance from the second point.

13. The sheet stacking tray assembly of claim 8, wherein at least one of the tray exit ramps is configured to slidably interconnect with the feeder, wherein the transition surface is configured to guide a sheet from the tray to the feeder.

14. The sheet stacking tray assembly of claim 8, wherein a first side of the tray exit ramp is configured to interconnect with the feeder.

15. The sheet stacking tray assembly of claim 8, wherein each tray exit ramp is configured to elevate a downwardly curled edge of a sheet until the edge is substantially level with a center portion of the sheet.

* * * * *